United States Patent [19]

St. Louis

[11] Patent Number: 4,656,340

[45] Date of Patent: Apr. 7, 1987

[54] HEATER COIL MOUNTING

[75] Inventor: Robert M. St. Louis, St. Leonard, Quebec, Canada

[73] Assignee: Camco Inc., Mississauga, Ontario, Canada

[21] Appl. No.: 729,044

[22] Filed: Apr. 30, 1985

[30] Foreign Application Priority Data

Oct. 12, 1984 [CA] Canada ..... 465325

[51] Int. Cl.[4] ..... H05B 3/06

[52] U.S. Cl. ..... 219/532; 338/305; 338/317; 219/542; 219/552

[58] Field of Search ..... 219/532, 536, 537, 546, 219/548, 552, 542; 174/138 J, 148, 167; 29/611; 248/68 R; 338/317, 305

[56] References Cited

U.S. PATENT DOCUMENTS

| | | | |
|---|---|---|---|
| 1,307,198 | 6/1919 | Harth | 219/532 X |
| 1,419,309 | 6/1922 | Russell | 219/532 |
| 1,493,386 | 5/1924 | Rice | 219/532 |
| 1,647,346 | 11/1927 | Ehrgott | 219/532 |
| 1,751,797 | 3/1930 | Dibble | 219/532 |
| 3,812,322 | 5/1974 | Osterkorn et al. | 219/532 |
| 3,920,887 | 11/1975 | Kloos et al. | 174/148 |
| 3,963,859 | 6/1976 | Petersen et al. | 174/148 |
| 3,967,094 | 6/1976 | Petersen et al. | 219/532 |

FOREIGN PATENT DOCUMENTS

| | | |
|---|---|---|
| 260881 | 5/1926 | Canada . |
| 771878 | 11/1967 | Canada . |
| 779440 | 2/1968 | Canada . |
| 889457 | 12/1971 | Canada . |
| 1017786 | 9/1977 | Canada . |

*Primary Examiner*—E. A. Goldberg
*Assistant Examiner*—M. M. Lateef
*Attorney, Agent, or Firm*—Raymond A. Eckersley

[57] ABSTRACT

A heater coil mounting is provided by means of a bracket having seats formed at or adjacent each axial end and into which an insulator through which the heater element passes, is adapted to be received. The bracket is mounted in position on a wall using tabs which cooperate with portions of the bracket to hold the bracket close to the wall and form a further portion of the seat to lock the insulator in position.

11 Claims, 11 Drawing Figures

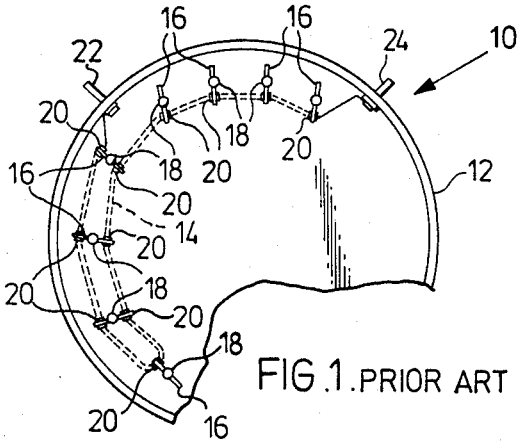
FIG. 1. PRIOR ART
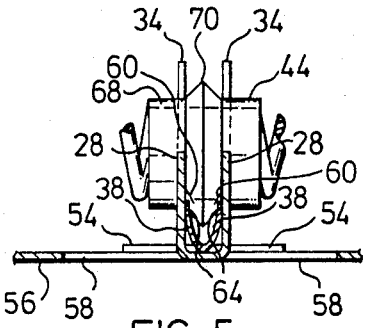
FIG. 5.
FIG. 2.
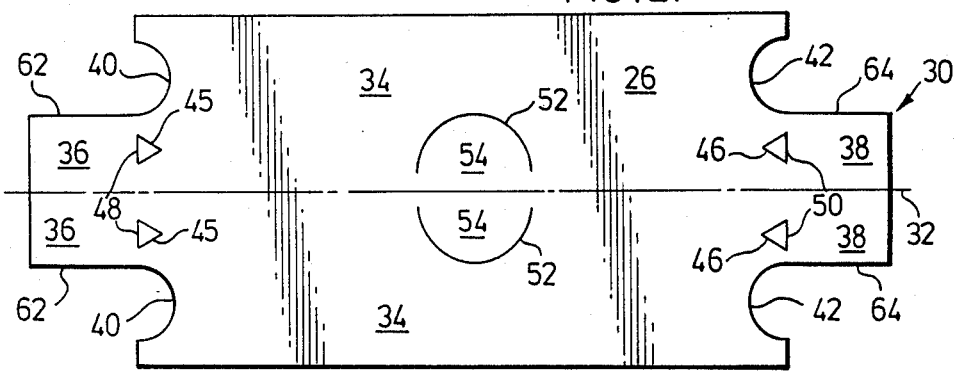
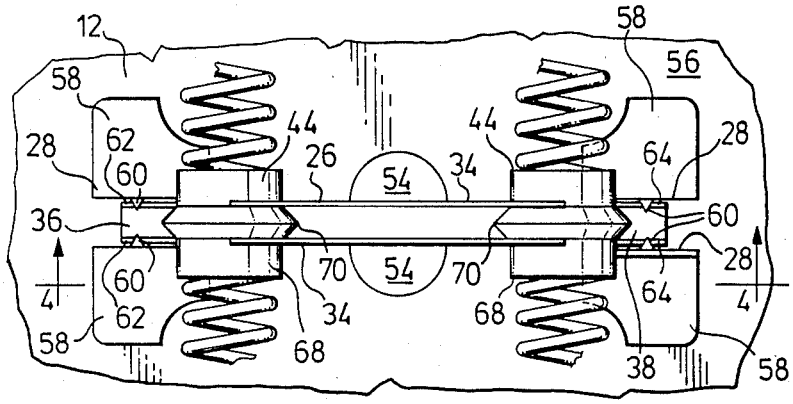
FIG. 3.
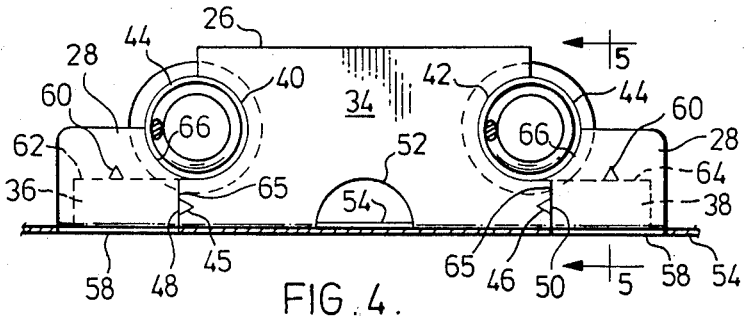
FIG. 4.

HEATER COIL MOUNTING

FIELD OF THE INVENTION

The present invention relates to a heater coil mounting. More particularly the present invention relates to a bracket adapted to support insulators which are locked into position when the bracket itself is moved into operative position in cooperating relationship with tabs projecting from a wall.

BACKGROUND OF THE INVENTION

Major appliances, such as automatic clothes dryers employ coil type heating elements that must be mounted in appropriate locations within the dryer structure. Generally, these heaters are formed by passing the coil element through ring or grommet type insulators generally made of porcelin and the like which in turn are supported by some form of metal support member that is secured in the proper location on the wall of the dryer. For example, the support member for the insulator may take the form of a wire formed into a U-shape with insulators supported at remote ends of the U and with the bridging section of the bracket secured by welding or generally by a sheet metal screw to the supporting wall. Such a device is shown for example, in Canadian Pat. No. 779,440, issued Feb. 27, 1968 to Himes.

It will be apparent that in the above patent the insulator is permanently fixed to the bracket so that the threading operation or mounting operation for the coil itself is relatively more complicated, i.e., the heating element cannot be effectively prethreaded by machine through the insulators unless a separate assembly step is formed after the brackets are mounted to the wall, i.e., the clipping of the insulators to the ends of the brackets which requires special manipulations and increases the costs. Alternatively if the insulators are premounted on the brackets then the heating element will normally be threaded through the insulators and assembly of the brackets with the heating element prethreaded becomes more cumbersome.

Canadian Pat. No. 260,881, issued May 18, 1926 to Weir discloses a coil element mounting arrangement wherein a ceramic element is fixed to the wall and is provided with a curved slot having an opening. The heating element may be passed through the opening into the undercut slot and retained therein after the insulators are mounted in position thereby facilitating threading of the heating element onto the assembled insulators.

Canadian Pat. No. 771,878, issued Nov. 14, 1967 to Kinney shows a system for clipping the insulator to a back wall using a mounting strip that is secured directly to the surface to which the heater is to be assembled.

Canadian Pat. No. 889,457 utilizes tabs struck out of the wall of the unit and fastens clips to which the insulating elements supporting the heating coil are mounted. This device facilitates mounting of the heating coil to the unit but incorporates a relatively complicated insulated unit having a pair of apertures. The bridge of each insulator extending between the two apertures is encircled by its respective clip structure that in turn is connected to its respective tab by a flange and a tongue threaded through an aperture in the tab.

Obviously such a structure is relatively expensive and does not provide a positive latch between its clip and tab, but does facilitate assembly.

Another type of mounting structure is shown in Canadian Pat. No. 1,017,786, issued Oct. 20, 1977 to Whiteman et al. In this device an insulator is mounted directly on the supporting structure via a projection extending through an aperture in the ceramic insulator. It utilizes a metal clip mounted on the ceramic insulator to hold the heating element in position. This structure is relatively weak and is expensive.

BRIEF DESCRIPTION OF THE PRESENT INVENTION

It is an object of the present invention to provide a relatively inexpensive mounting for a coil heating element, more particularly, to provide a bracket that may be snapped into position on the mounting wall of the appliance to lock the ceramic insulator in position spaced from the mounting wall.

Broadly, the present invention comprises a heater coil mounting comprising a bracket, seat portions formed in each axial end of said bracket, said seat portions being adapted to seat an insulating means, tab means projecting from a wall on which said bracket is to be mounted, one at each axial end of said bracket, further seat portions formed on each said tab means, said further seat portions being adapted to cooperate with their adjacent seat portions on said bracket to lock insulating means in position in said cooperating seat portions when said bracket is in mounted position relative to said tab means, cooperating means on said bracket and said tab means for latching said bracket in position relative to said wall.

In a preferred structure, the bracket is provided with lateral extensions projecting from each axial end thereof and the tab means are formed by two pairs of tabs, one pair located at each opposite axial end of the bracket so that each extension is received between its adjacent pair of tabs and the latching includes indents formed on the tab and over-lying the adjacent edge of the extension to impair movement of the bracket away from the wall.

Bracket movement parallel to the wall may be inhibited by means of a detent formed on the wall and received in a pocket formed in the bracket the detent engaging edges of the pocket, to prevent movement of the bracket.

BRIEF DESCRIPTION OF THE DRAWINGS

Further features, objects and advantages will be evident from the following detailed description of the preferred embodiments of the present invention taken in conjunction with the accompanying drawings, in which:

FIG. 1 is an elevation view of a typical installation incorporating the heater element mounted in position by wire clips used in the prior art;

FIG. 2 is a plan view of a sheet metal blank adapted to form the bracket of the present invention;

FIG. 3 is an elevation view of a bracket formed from the blank of FIG. 2 mounted in position on a wall of the appliance;

FIG. 4 is a section along the line 4—4 of FIG. 3 with the coil element omitted;

FIG. 5 is a section along the line 5—5 of FIG. 4;

DESCRIPTION OF THE PREFERRED EMBODIMENTS

Figure 6:
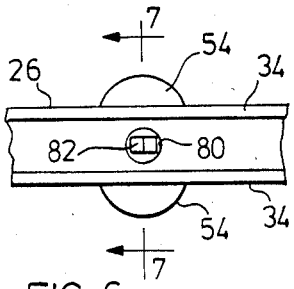
FIG. 6 is a plan view of a central portion of the bracket shown in FIG. 3 illustrating an alternate form of lateral positioning.

FIG. 1 illustrates a typical mounting for a heating element of a dryer structure 10 having a heater housing 12 in which a heater element generally indicated at 14 is mounted. The heater element 14 is held in position by a plurality of metal clips 16 formed from strips of metal, i.e., wire of any suitable cross section, mounted to the heater housing 12 by screws 18. The heater element formed by a wire coil 14 passes through a plurality of ceramic insulators 20 held by the metal clips 16. It will be noted that some of the metal clips contain two ceramic insulators and others only one. For example, those in the upper portion of the drawing have a single insulator whereas those to the left have two insulators and the bottom clip 16 has only a single insulator.

The opposite ends of the heater coil 14 are connected to suitable terminals 22 and 24 respectively in the conventional manner.

The bracket 26 of the FIGS. 2 to 5 embodiment of the present invention replaces the bracket 16 of the prior art while tabs 28 (there being four such tabs for each bracket 26), are formed from the wall of the housing 12 and replace the screws 18.

The bracket 26 is formed from a blank 30 as illustrated in FIG. 2 by bending into a substantially V-shape bracket (as herein used the term V-shape is intended to include other similar shapes such as U-shape, C-shape, etc.). The blank 30 of FIG. 2 is divided into two symmetrical halves by a substantially longitudinally extending centre line 32. The blank is thus provided with a pair of leg members 34 each having extensions 36 and 38 and at opposite longitudinal ends thereof. Each of the legs 34 is also formed with a seat 40 at one longitudinal end thereof and a seat 42 at the opposite longitudinal end thereof. The seats 40 and 42 are adapted to partially encircle an insulator such as the insulator generally indicated at 44 in FIG. 3 while permitting the insulator to be freely slid into and out of the seats 40 and 42.

Each of the legs 34 is also provided with indentations 45 at one end thereof, and 46 at the opposite end thereof which provide abutment edges 48 and 50 respectively adapted to cooperate with edges of the tabs 28 as will be described hereinbelow to prevent lateral shifting of the bracket relative to the housing 12.

Each of the legs 34 is also provided with a substantially semi-circular slit 52 adapted to form stabilizing legs 54 when the blank 30 is formed into the bracket 26.

The blank 30 is folded symmetrically about its longitudinal centre line 32 to bring the legs 34 into substantially parallel relationship as shown for example, in FIG. 5 with the stabilizing legs 54 extending substantially perpendicular to the legs 34.

As above indicated, suitable tabs 28 are bent out of the wall 56 of the housing 12 which forms apertures 58 in the housing wall 56. Each of the tabs 28 is provided with a projection 60 spaced from the wall 56 by a distance substantially equal to the height of the longitudinal edges 62 and 64 of the extensions 36 and 38 of the bracket 26 from the apex of the V so that the edges of these projections 60 directly overlie the edges 62 and 64 of the extensions 36 and 38 respectively and hold the bracket 26 against the wall 56.

Each of the tabs 28 is also provided with a further seat portion 66 (see FIG. 4) which provides an extension of the adjacent seat portions 40 and 42 and cooperates with these seat portions to lock the ceramic insulator 44 in position.

The spacing between the edges 48 and 50 of the indentation tabs 44 and 46 is substantially equal to the spacing between the inner edges 65 of pairs of opposed tabs 28 (see FIG. 4).

Each of the insulators 44 is formed of a substantially cylindrical section 68 with a raised circumferential boss portion 70 located about mid-way along its length. The portion 70 is adapted to be received between the legs 34 of the bracket 26 as shown for example, in FIGS. 3 and 5 to prevent significant axial movement of the insulator 44.

The mounting of the present invention is formed by bending the blank 30 into the V-shaped bracket 26 by moving the legs 34 into substantially parallel relationship while forcing the support legs 54 to remain in position substantially perpendicular to the legs 34. Suitable insulators may be inserted into the seats 42 and 44 with the raised portions 70 thereof received between the legs 34 as shown in FIG. 3. The unit is then forced into position with the extensions 38 located between a pair of tabs 28 and the extensions 36 located between a second pair of tabs 28 at the opposite end of the bracket.

The tabs 28 are sufficiently resilient so that they flex to move the projection 60 out of the way as the extensions 36 and 38 move therepast until the edges 62 and 64 are located beneath the edges of the projections 60.

It will be apparent that the indentations 45 and 46, particularly their edges 48 and 50 respectively, accurately position the bracket laterally on the wall 56 by engagement between the edges 48 and 50 with the adjacent inner edges 65 of the tabs 28.

It will be noted that the further seat portion 66 provided on the tabs 28 cooperate with the seat portion 40 or 42 to produce a seat extending around more than 180° of the cylindrical section 68 of the insulator 44 and thereby lock the insulator in position on the bracket 26. Insulator 44 is firmly held in position, for example, by two adjacent seat portions 40 at adjacent ends of legs 34 cooperating with two further seat portions 66 of the tabs 28, similarly the two seat portions 42 cooperate with the seat portions 66 on the adjacent tabs 28. The boss 70 of the insulator in seats 40 is trapped between the adjacent seats 40 on the legs 34 and between the adjacent seats 66 on the cooperating adjacent tabs 28 and similarly the boss 70 of the insulator in seat 42 is trapped between the adjacent seats 42 on the legs 34 and between the adjacent seats 66 on the cooperating adjacent tabs 28 thereby holding the insulator in position.

If desired, the indentations 45 may be omitted completely since the further seat portions 66 will prevent lateral movement of the unit. However, it is preferred not to apply any pressure to the insulator thus some form of lateral positioning means other than the cooperation between the further seat and the insulator is preferably provided.

Figure 7:
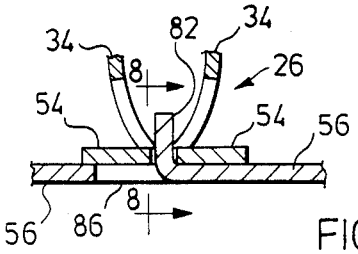
FIG. 7 is a section along the line 7—7 of FIG. 6.
Figure 8:
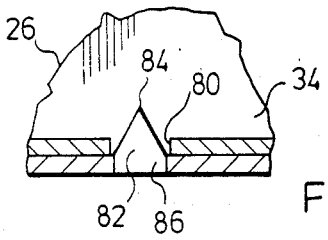
FIG. 8 is a section along the line 8—8 of FIG. 7.

Another alternative for assuring proper lateral positioning of the bracket is to replace the indentations 45 with an aperture such as the aperture indicated at 80 in FIGS. 6, 7 and 8. This aperture 80 is formed in the illustrated arrangement at about the mid-point of the bracket 26 at about the apex of the V-shape where the two legs 34 come together. A suitable detent or pin 82 which preferably is tapered to an apex 84 as shown in FIG. 8, is cut from the wall 56 and bent into a position substantially perpendicular thereto and then passes up through the aperture 80. Obviously contact of the side edges of the pin 82 with the edges of the aperture or pocket 80 limit any movement of the bracket 26.

The type of positioning arrangement shown in FIGS. 6–8 is preferred as the tapering pin 82 automatically adjusts the position of the bracket as the bracket is moved down onto the pin.

Figure 9:
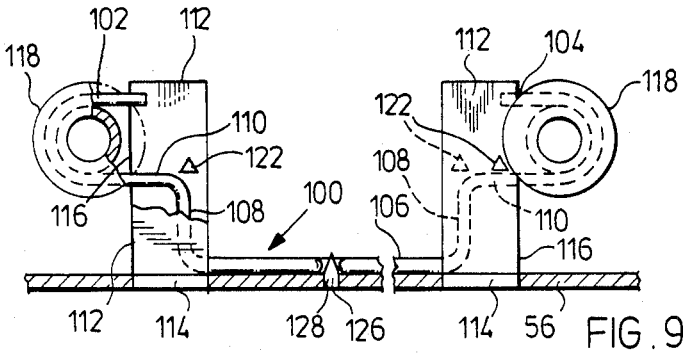
FIG. 9 is an elevation view similar to FIG. 4 illustrating another form of the invention with parts broken away for clarity.
Figure 10:
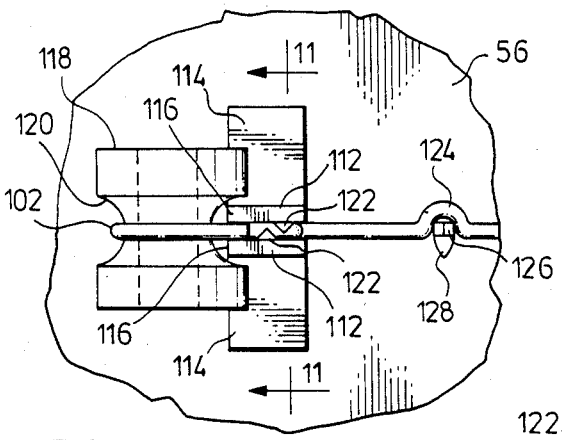
FIG. 10 is a view similar to FIG. 3 but showing only the left hand end of the mounting shown in FIG. 9.
Figure 11:
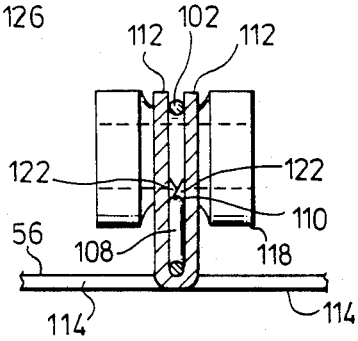
FIG. 11 is a view similar to FIG. 5 but taken along the line 11—11 of FIG. 10.

Referring now to FIGS. 9–11 a modification of the invention is shown wherein in place of a U-shaped bracket a wire bracket is used and wherein the seats formed in the bracket open in the direction facing each other rather than toward the outer axial extremities of the bracket as shown in FIGS. 2–5 inclusive. Obviously the wire bracket may be modified to have seats opening outwardly and the sheet metal U-shaped bracket of FIGS. 2 to 5 may be modified to have the seats opening inwardly.

In the arrangement shown in FIGS. 9, 10 and 11 a wire bracket 100 is composed of a pair of curved seats 102 and 104 at opposite ends thereof the seats opening in a direction facing each other. These seats are interconnected by integral U-shaped bridging section 106 having a pair of arms 108 each connected to lateral inward extensions 110 of the seats 102 and 104 respectively. The arms 108 provide the spacing between the wall 56 of the appliance and the seat 102 and 104.

Four tabs each indicated at 112 (only three illustrated) are formed by rectangular cut-outs formed in the wall 56 leaving apertures 114 in the wall 56. The outer edges 116 of these tabs 112 form further seat portions which cooperate with the seats 102 and 104 to lock the insulator indicated at 118 in position the edges 116 traversing the opening or entry into the seats 102 and 104.

The insulators 118 are each substantially right cylindrical in shape and are provided with circumferential indentations 120 sufficiently wide to receive the seat portion 102 or 104 together with the two retaining tabs 112 which cooperate with the seat portion 102 and 104 to lock the insulator in position as shown for example in FIG. 10.

As can be seen from FIG. 9, the closer tab 112 of the pair of tabs cooperating with the seat 102 has been broken away to show the section 110 and leg 108 as has the insulator 118 to show the narrowed section at the base of the annular indentation 120.

The bracket 100 is held in position against the wall 56 by pairs of indentations 122 substantially equivalent to the projections 60 described hereinabove there being one indentation 122 on each of the tabs 112.

In order to laterally position the bracket 100, the bridging section 106 is provided with a U-shaped curved section or pocket 124 which is adapted to receive a pin 126 substantially equivalent to the pin 82 shown in FIGS. 6 to 8 inclusive formed by bending a tab 126 cutting the shape of the pin 126 into the wall 56 and then bending same perpendicular to the wall 56 to leave an aperture 128.

It will be apparent in both of the above arrangements whether the seats extend or open inwardly or outwardly the cooperating retaining tabs form further seat portions to lock the insulators such as the insulator 118 or 44 to the bracket 100 or 26 as well as locking the bracket to the wall 56.

Having described the invention, modifications will be evident to those skilled in the art without departing from the spirit of the invention as defined in the appended claims.

What I claim as new and desire to secure by Letters Patent of the United States is:

1. A heater element assembly comprising:

an electric heating element;

insulating means surrounding portions of the electric heating element;

a bracket having opposing ends, first seat portions formed at each of the opposing ends of said bracket, each of said seat portions having an opening for receiving the insulating means for mounting the electric heating element; and, a wall on which said bracket is mounted, a plurality of tab means projecting from said wall, there being at least one said tab means adjacent each of said opposing ends of said bracket, second seat portions on said tab means, each of said second seat portions engaging said insulating means and cooperating with a corresponding adjacent one of said first seat portions on said bracket to secure said insulating means in the heater element assembly and means for securing said bracket to said wall.

2. A heater element assembly as defined in claim 1 wherein each of said first seat portions opens axially outward from its respective said opposing end of said bracket.

3. A heater element assembly as defined in claim 1 wherein said openings of said first seat portions at said opposite axial ends of said bracket face each other.

4. A heater element assembly as defined in claim 1 wherein said bracket is substantially V-shaped in cross section and is formed by a pair of legs, each of said legs being provided with said first seat portions at each axial end thereof.

5. A heater element assembly as defined in claim 2 wherein said bracket is substantially V-shaped in cross section and is formed by a pair of legs, each of said legs being provided with said first seat portions at each axial end thereof.

6. A heater element assembly as defined in claim 3 wherein said bracket is substantially V-shaped in cross section and is formed by a pair of legs, each of said legs being provided with said first seat portions at each axial end thereof.

7. A heater element assembly as defined in claim 4 wherein said securing means comprises projections on said tabs cooperating with edges on said bracket to prevent movement of said bracket away from said wall.

8. A heater element assembly as defined in claim 7 further comprising pin means projecting from said wall, a cooperating receiving pocket formed in said bracket, cooperation between said pin means and the cooperating pocket into which the pin means projects limiting axial movement of said bracket relative to said wall.

9. A heater element assembly as defined in claim 4 wherein said insulating means comprises a substantially hollow right cylindrical member having a radially extending portion extending circumferentially thereabout at a location spaced from each axial end of said cylinder member and wherein said radially extending portions is received between said legs of said bracket.

10. A heater element assembly as defined in claim 1 further comprising pin means projecting from said wall, a cooperating receiving pocket formed in said bracket, cooperation between said pin means and the cooperating pocket into which the pin means projects limiting axial movement of said bracket relative to said wall.

11. A heater element assembly as defined in claim 4 further comprising pin means projecting from said wall, a cooperating receiving pocket formed in said bracket, cooperation between said pin means and the cooperating pocket into which the pin means projects limiting axial movement of said bracket relative to said wall.

* * * * *